US010870524B2

(12) United States Patent
Zhang et al.

(10) Patent No.: US 10,870,524 B2
(45) Date of Patent: Dec. 22, 2020

(54) CUSHIONING APPARATUS

(71) Applicants: Maintek Computer (Suzhou) Co., Ltd, JiangSu (CN); PEGATRON CORPORATION, Taipei (TW)

(72) Inventors: Shi-Wang Zhang, JiangSu (CN); Hsin-Chang Lu, Taipei (TW)

(73) Assignees: MAINTEK COMPUTER (SUZHOU) CO., LTD., Jiangsu (CN); PEGATRON CORPORATION, Taipei (TW)

( * ) Notice: Subject to any disclaimer, the term of this patent is extended or adjusted under 35 U.S.C. 154(b) by 96 days.

(21) Appl. No.: 16/245,340

(22) Filed: Jan. 11, 2019

(65) Prior Publication Data

US 2019/0233194 A1 Aug. 1, 2019

(30) Foreign Application Priority Data

Jan. 31, 2018 (CN) ..... 2018 1 0093974

(51) Int. Cl.
*B65D 81/05* (2006.01)
*B65D 85/30* (2006.01)
*B65D 81/113* (2006.01)

(52) U.S. Cl.
CPC ..... *B65D 81/057* (2013.01); *B65D 81/058* (2013.01); *B65D 85/30* (2013.01); *B65D 81/113* (2013.01)

(58) Field of Classification Search
CPC .... B65D 81/058; B65D 85/30; B65D 81/053; B65D 81/054; B65D 81/055; B65D 81/056; B65D 81/057; B65D 81/107; B65D 81/113
USPC ..... 206/585, 586, 523, 512, 521
See application file for complete search history.

(56) References Cited

U.S. PATENT DOCUMENTS 4,883,179 A * 11/1989 Dionne ..... B29C 53/066 206/523
7,398,884 B2 * 7/2008 Stegner ..... B65D 81/113 206/521
7,543,706 B2 * 6/2009 Huang ..... B65D 5/5002 206/523
2014/0001085 A1 * 1/2014 Zhao ..... B65D 85/30 206/722
2017/0113862 A1 4/2017 Malone

FOREIGN PATENT DOCUMENTS

CN 106516332 A 3/2017

* cited by examiner

*Primary Examiner* — Rafael A Ortiz
(74) *Attorney, Agent, or Firm* — McClure, Qualey & Rodack, LLP

(57) ABSTRACT

A cushioning apparatus includes a first connecting block, a second connecting block, a first cushioning block, a second cushioning block, a third cushioning block, and a fourth cushioning block. An outer end portion of the first cushioning block is fixedly connected to the first connecting block. An outer end portion of the second cushioning block is fixedly connected to the second connecting block. A top surface of an outer end portion of the third cushioning block is connected to a top surface of the first connecting block in a flippable manner. A top surface of an outer end portion of the fourth cushioning block is connected to a top surface of the second connecting block in a flippable manner.

8 Claims, 9 Drawing Sheets

CUSHIONING APPARATUS

CROSS-REFERENCE TO RELATED APPLICATION

This application claims priority to Chinese Application Serial Number 201810093974.7, filed Jan. 31, 2018, which is herein incorporated by reference in its entirety.

BACKGROUND

Field of Invention

The disclosure relates to a cushioning apparatus, and in particular, to a cushioning apparatus capable of reducing material waste.

Description of Related Art

People usually use cushioning materials in packaging boxes to protect items to prevent the items from damage due to impact or compression during shipment. Moreover, when a packaged item is thicker, a cushioning material usually needs to be correspondingly thicker to form a deeper accommodation space. Consequently, the cushioning material needs to be manufactured by a thicker material. In addition, a large quantity of residual materials are generated during the manufacture of the cushioning material. The residual materials usually need to be cut into predetermined sizes, and therefore it is difficult to directly use the residual materials. Accordingly, the residual materials are usually discarded to cause waste.

SUMMARY

Accordingly, an objective of the disclosure is to provide a cushioning apparatus to improve the prior art.

According to the objective of the disclosure, a cushioning apparatus includes a first connecting block, a second connecting block, at least one first cushioning block, at least one second cushioning block, at least one third cushioning block, and at least one fourth cushioning block. An outer end portion of the first cushioning block is fixedly connected to the first connecting block. An outer end portion of the second cushioning block is fixedly connected to the second connecting block. A top surface of an inner end portion, far away from the second connecting block, of the second cushioning block is connected to a top surface of an inner end portion, far away from the first connecting block, of the first cushioning block in a flippable manner. A top surface of an outer end portion of the third cushioning block is connected to a top surface of the first connecting block in a flippable manner. A top surface of an outer end portion of the fourth cushioning block is connected to a top surface of the second connecting block in a flippable manner. A bottom surface of an inner end portion, far away from the second connecting block, of the fourth cushioning block is connected to a bottom surface of an inner end portion, far away from the first connecting block, of the third cushioning block in a flippable manner.

In one or more implementations of the disclosure, the number of the at least one first cushioning block may be two, and the number of the at least one second cushioning block may also be two. The third cushioning block may be located between the two first cushioning blocks. The fourth cushioning block may be located between the two second cushioning blocks.

In one or more implementations of the disclosure, when an inner end surface of the inner end portion of the first cushioning block contacts an inner end surface of the inner end portion of the second cushioning block, the two first cushioning blocks, the two second cushioning blocks, the first connecting block, and the second connecting block may enclose to form an accommodation space. The third cushioning block and the fourth cushioning block may be confined in the accommodation space.

In one or more implementations of the disclosure, the number of the at least one third cushioning block may be two, and the number of the at least one fourth cushioning block may also be two. The first cushioning block may be located between the two third cushioning blocks. The second cushioning block may be located between the two fourth cushioning blocks.

In one or more implementations of the disclosure, a first connecting edge may be provided between an inner end surface of the inner end portion of the first cushioning block and an inner end surface of the inner end portion of the second cushioning block. The first connecting edge may be parallel to a direction. A second connecting edge may be provided between an inner end surface of the inner end portion of the third cushioning block and an inner end surface of the inner end portion of the fourth cushioning block. The second connecting edge may be parallel to the direction. A third connecting edge may be provided between an outer end surface of the outer end portion of the third cushioning block and the first connecting block. The third connecting edge may be parallel to the direction. A fourth connecting edge may be provided between an outer end surface of the outer end portion of the fourth cushioning block and the second connecting block. The fourth connecting edge may be parallel to the direction.

According to an implementation of the disclosure, the cushioning apparatus includes at least one cushioning unit. The cushioning unit has a bottom surface and a top surface opposite to each other and has a first lateral surface and a second lateral surface opposite to each other. The first lateral surface and the second lateral surface are both connected to the bottom surface and the top surface. The cushioning unit further has a first cutting groove, a second cutting groove, a third cutting groove, a fourth cutting groove, and a fifth cutting groove. The first cutting groove is located between the first lateral surface and the second lateral surface and communicates with the bottom surface and the top surface. The second cutting groove extends from the first cutting groove to the second lateral surface, and a bottom portion of the second cutting groove is separated from the bottom surface. The third cutting groove extends from the first cutting groove to the first lateral surface, and a bottom portion of the third cutting groove is separated from the top surface. The fourth cutting groove extends from one end portion of the first cutting groove to the second lateral surface, and a bottom portion of the fourth cutting groove is separated from the top surface. The fifth cutting groove extends from the other end portion of the first cutting groove to the second lateral surface, and a bottom portion of the fifth cutting groove is separated from the top surface.

In one or more implementations of the disclosure, depths of the second cutting groove, the third cutting groove, the fourth cutting groove, and the fifth cutting groove may be at least greater than a half of a thickness of the cushioning unit, respectively.

In conclusion, in the cushioning apparatus of the disclosure, a plurality of cushioning blocks are folded towards each other based on connecting blocks to form a clamping groove for placing an accommodated item to absorb a shock via the thickness of the cushioning blocks. Accordingly, when the accommodated item is impacted, the cushioning apparatus is compressed to absorb impact energy to prevent the accommodated item from damage due to impact. In addition, in the disclosure, the cushioning apparatus is formed by cutting a plurality of cutting grooves on a cushioning unit. Accordingly, the cushioning apparatus including the cushioning unit may be formed by cutting a single board body thus to save the time for manufacturing the cushioning apparatus. In addition, the cushioning apparatus of the disclosure can be completed only by the cutting step, so that a large quantity of residual materials may not be generated during manufacture. In addition, material waste is reduced during manufacture, so that manufacturing cost of the cushioning apparatus can be further reduced.

DETAILED DESCRIPTION

Figure 1:
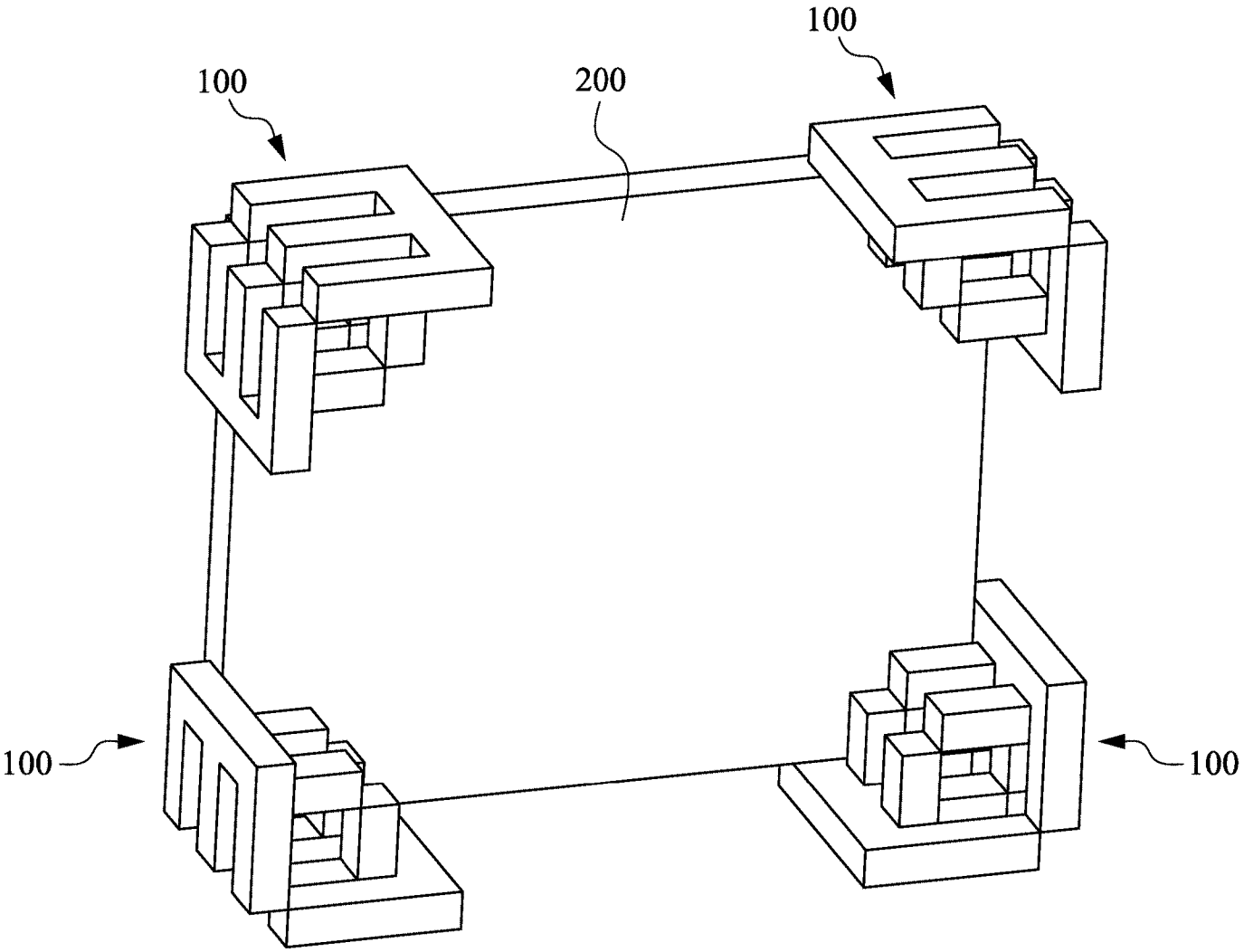
FIG. 1 is a three-dimensional diagram showing that an accommodated item is placed in a plurality of cushioning apparatuses according to an implementation of the disclosure.

The following descriptions provide various different implementations or embodiments to implement the subject of the disclosure. Specific examples of elements or arrangements are discussed below to simplify the disclosure. Certainly, these descriptions are only some examples and the disclosure is not limited thereto. For example, a description that a first feature is formed on or above a second feature includes an implementation in which the first feature and the second feature directly contact and also includes an implementation in which another feature is formed between the first feature and the second feature and the first feature and the second feature do not directly contact in this case. In addition, numerals or texts may be repeated in different examples in the disclosure. The objective of repetition is to simplify and clarify descriptions rather than to define a relationship between the discussed different implementations and configurations.

In addition, the terms "under", "below", "lower", "on", "above", and other similar terms representing spatial relativity are used herein to easily describe a relationship between an element or a feature and another element or feature in the drawings. The terms representing spatial relativity should cover orientations depicted in the drawings and further cover other orientations during the use or operation of an apparatus. That is, when the orientation of the apparatus is different from that in the accompanying drawings (rotation by 90 degrees or in another orientation), the terms representing spatial relativity used in this specification may also be correspondingly explained.

Figure 2A:
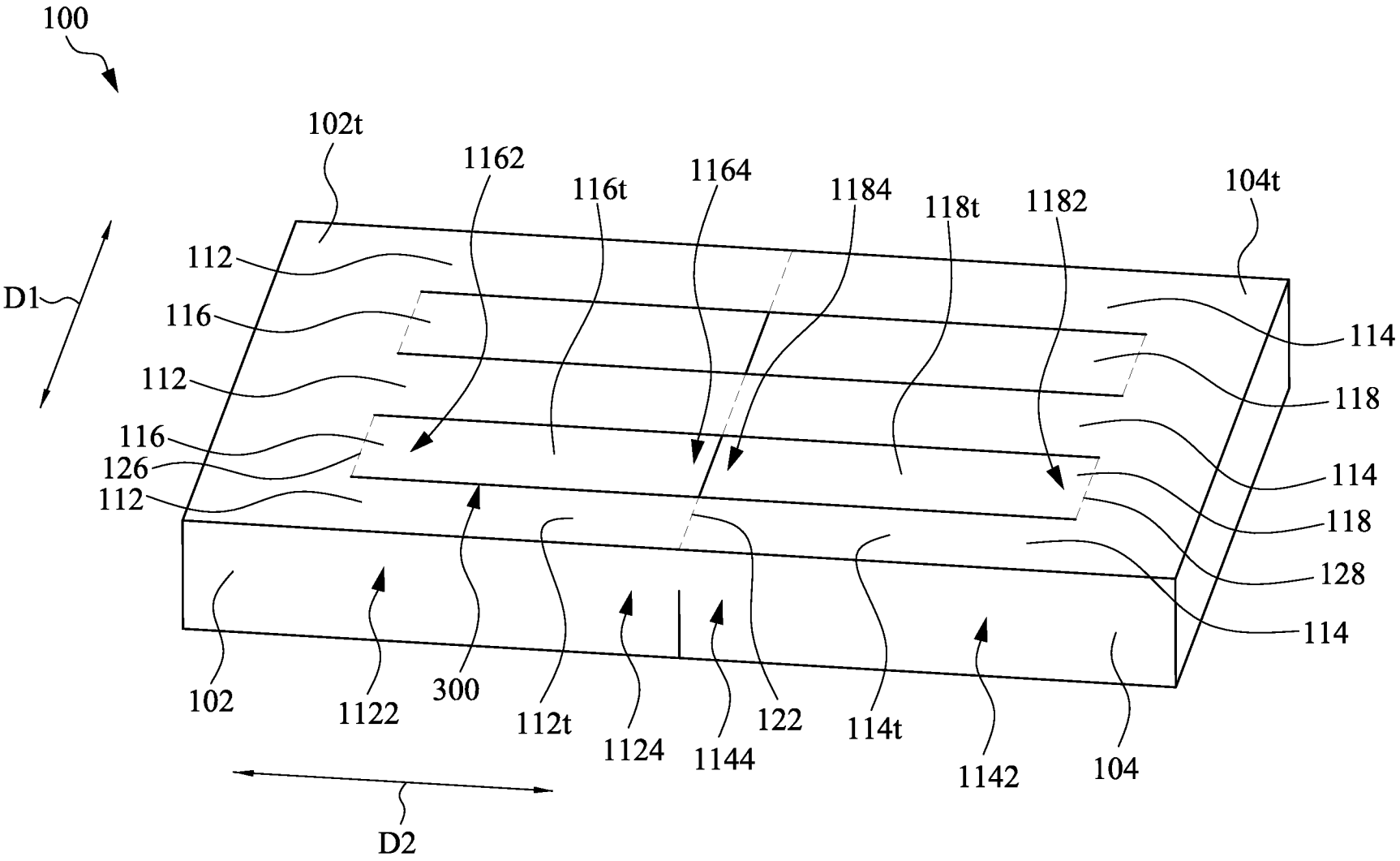
FIG. 2A, FIG. 2B, and FIG. 2C are respectively three-dimensional diagrams of a cushioning apparatus being in different deployed states according to an implementation of the disclosure.
Figure 2B:
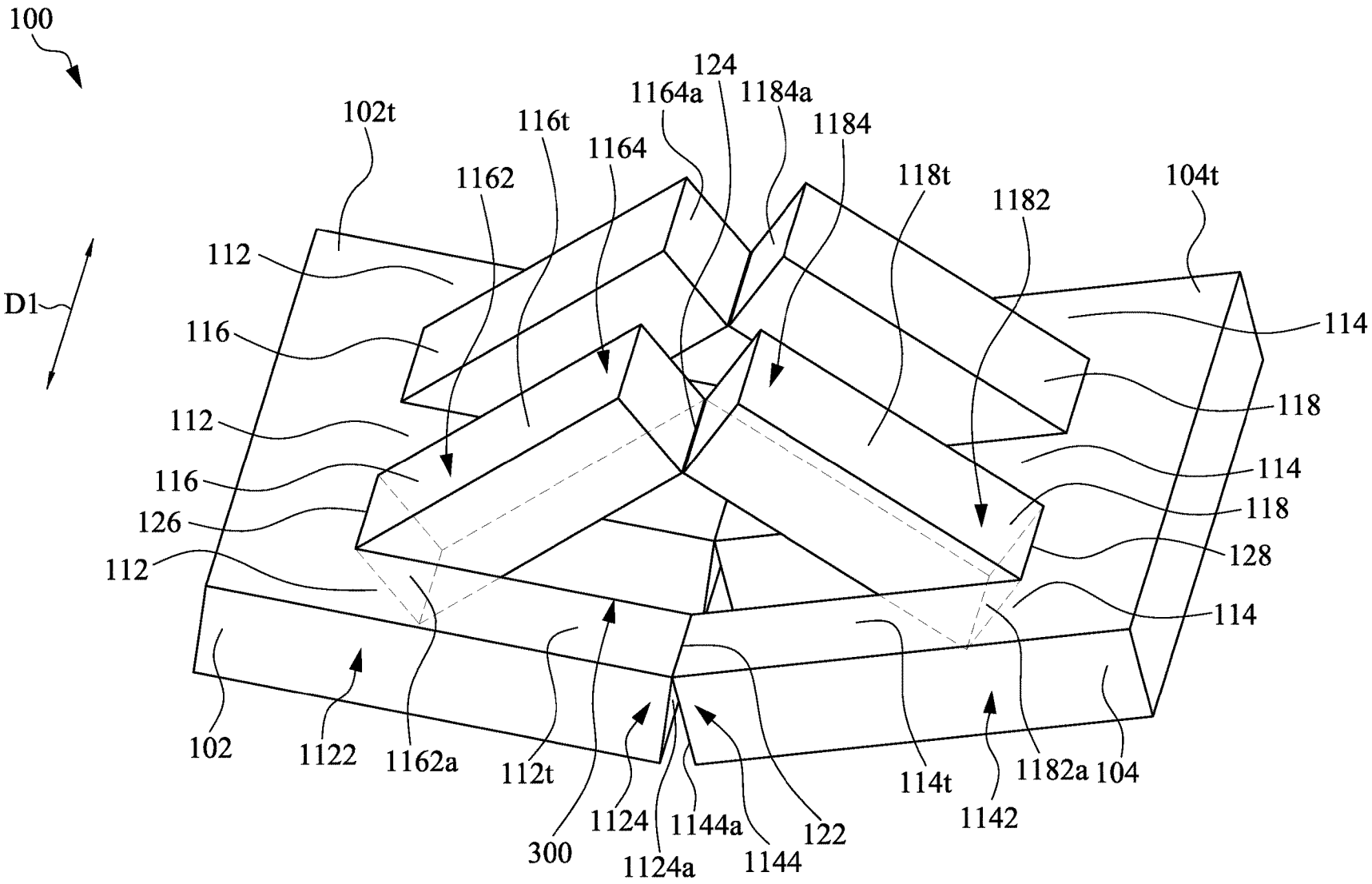
Figure 2C:
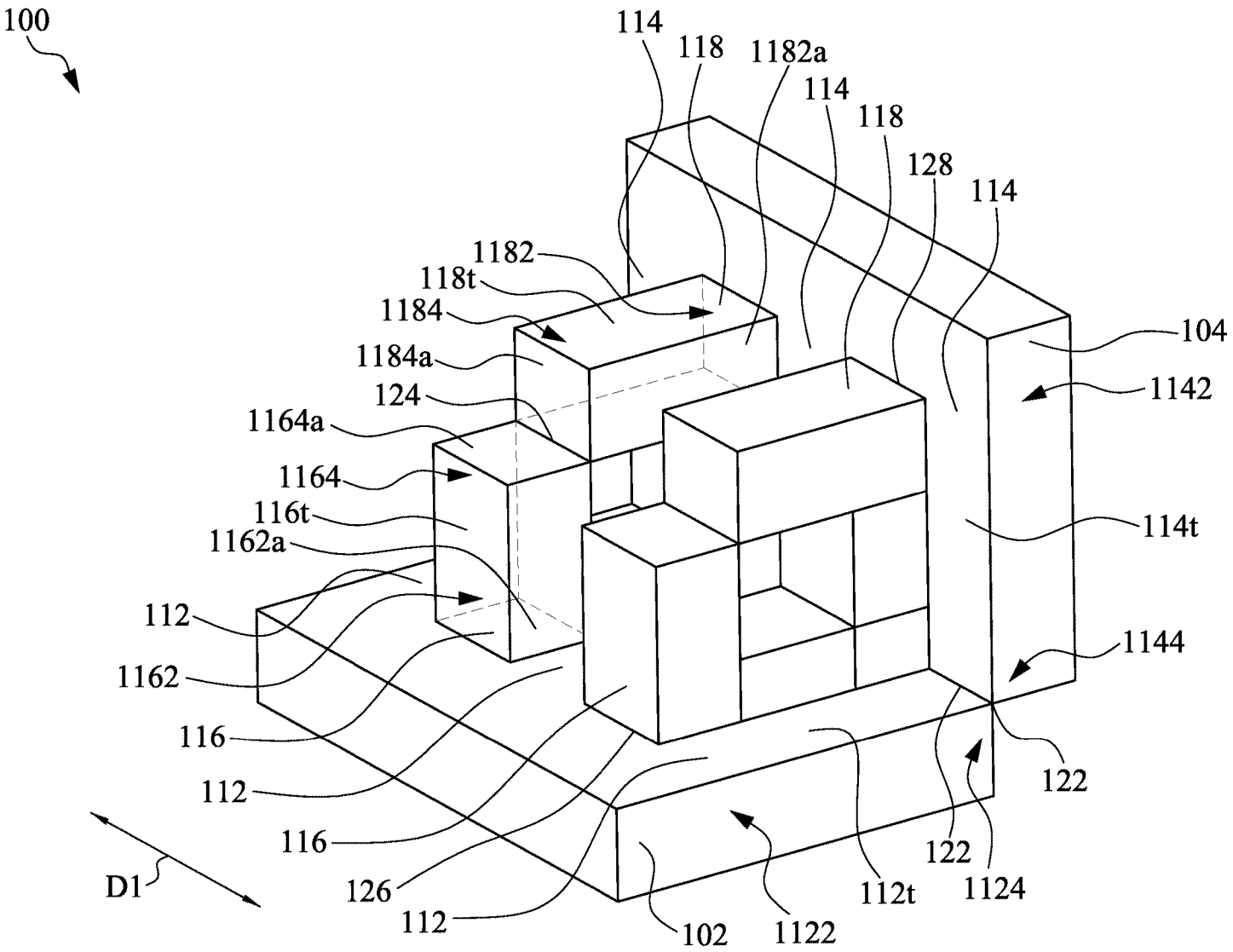
Figure 2D:
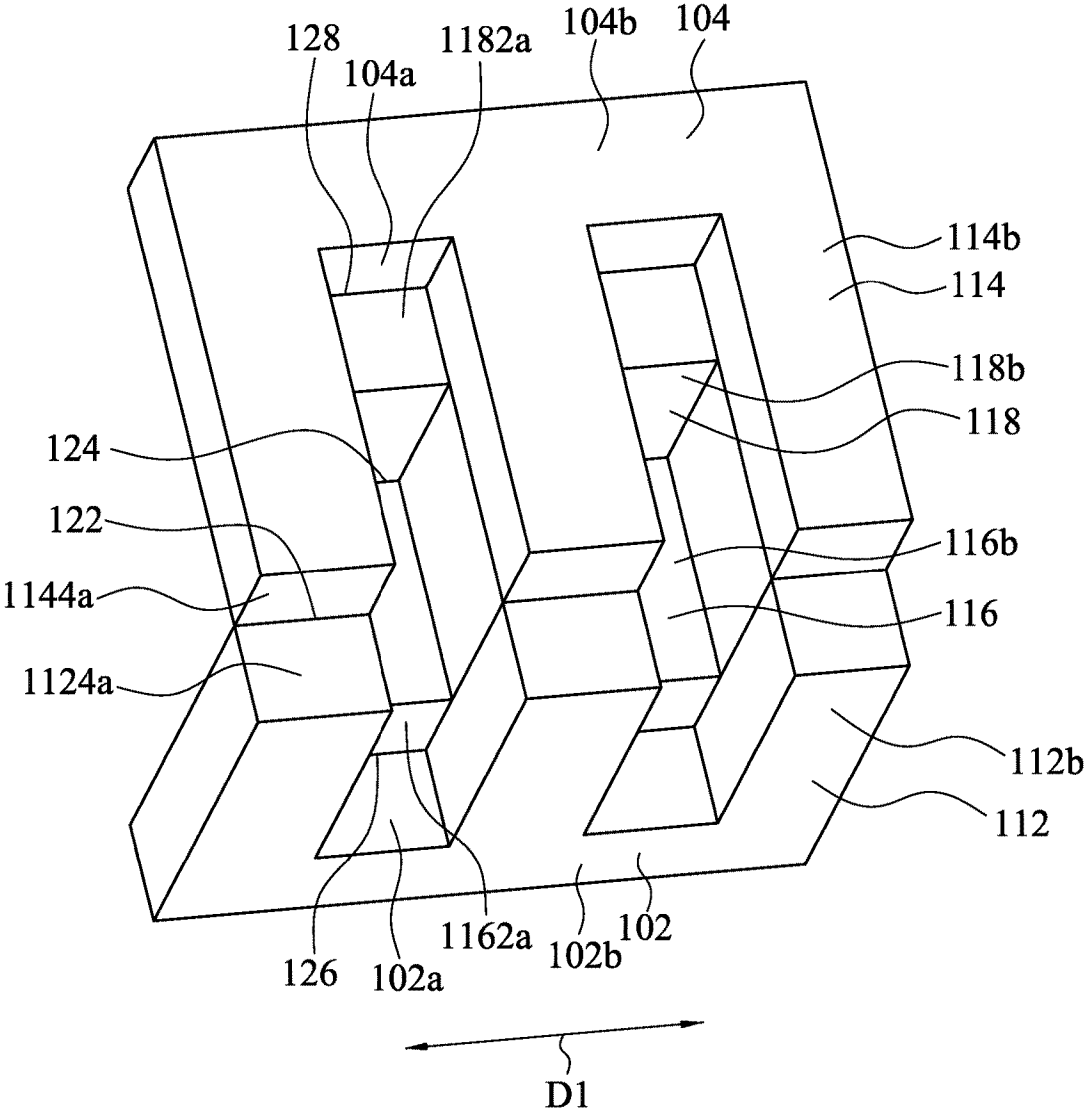
FIG. 2D is a three-dimensional diagram of the cushioning apparatus in FIG. 2C from another angle.

Please refer to FIG. 1 to FIG. 2D. FIG. 1 is a three-dimensional diagram showing that an accommodated item 200 is placed in a plurality of cushioning apparatuses 100 according to an implementation of the disclosure. FIG. 2A, FIG. 2B, and FIG. 2C are respectively three-dimensional diagrams of a cushioning apparatus 100 being in different deployed states according to an implementation of the disclosure. FIG. 2A shows a state before the cushioning apparatus 100 is deployed. FIG. 2B to FIG. 2D show states after the cushioning apparatus 100 are deployed. FIG. 2D is a three-dimensional diagram of the cushioning apparatus 100 in FIG. 2C from another angle. As shown in the figures, in this implementation, the cushioning apparatus 100 includes a first connecting block 102, a second connecting block 104, at least one first cushioning block 112 (where three first cushioning blocks 112 are depicted), at least one second cushioning block 114 (where three second cushioning blocks 114 are depicted), at least one third cushioning block 116 (where two third cushioning blocks 116 are depicted), and at least one fourth cushioning block 118 (where two fourth cushioning blocks 118 are depicted). The structures and functions of the elements and connection relationships between the elements are described below in detail.

In FIG. 2A, the first connecting block 102 and the second connecting block 104 of the cushioning apparatus 100 are rectangular columns and extend in a first direction D1. The first connecting block 102 has a bottom surface 102*b* (in FIG. 2D) and a top surface 102*t* that are opposite to each other and has an end surface 102*a* (in FIG. 2D) facing the second connecting block 104. The end surface 102*a* of the first connecting block 102 is connected to the bottom surface 102*b*. The second connecting block 104 has a bottom surface 104*b* (in FIG. 2D) and a top surface 104*t* that are opposite to each other and has an end surface 104*a* (in FIG. 2D) facing the first connecting block 102. The end surface 104*a* of the second connecting block 104 is connected to the bottom surface 104*b*.

In FIG. 2A, the first cushioning block 112, the second cushioning block 114, the third cushioning block 116, and the fourth cushioning block 118 of the cushioning apparatus 100 are rectangular columns extending in a second direction D2 and are located between the first connecting block 102 and the second connecting block 104. In some implementations, the first direction D1 intersects the second direction D2. In this implementation, the first direction D1 is perpendicular to the second direction D2.

In this implementation, the first cushioning blocks 112 and the third cushioning blocks 116 are alternately arranged in the first direction D1, and the second cushioning blocks 114 and the fourth cushioning blocks 118 are alternately arranged in the first direction D1. In other words, the third cushioning block 116 is located between the two adjacent first cushioning blocks 112, and the fourth cushioning block 118 is located between the two adjacent second cushioning blocks 114.

Specifically, the first cushioning block 112 of the cushioning apparatus 100 has a bottom surface 112*b* (in FIG. 2D) and a top surface 112*t* opposite to each other and has an outer end portion 1122 and an inner end portion 1124 opposite to each other. The outer end portion 1122 is near the first connecting block 102, and the inner end portion 1124 is far away from the first connecting block 102. The inner end portion 1124 of the first cushioning block 112 has an inner end surface 1124*a* (in FIG. 2D) facing the second cushioning block 114. The inner end surface 1124*a* of the first cushioning block 112 is connected to the bottom surface 112*b*. The second cushioning block 114 of the cushioning apparatus 100 has a bottom surface 114*b* (in FIG. 2D) and a top surface 114*t* opposite to each other and has an outer end portion 1142 and an inner end portion 1144 opposite to each other. The outer end portion 1142 is near the second connecting block 104, and the inner end portion 1144 is far away from the second connecting block 104. The inner end portion 1144 of the second cushioning block 114 has an inner end surface 1144*a* (in FIG. 2D) facing the first cushioning block 112. The inner end surface 1144*a* of the second cushioning block 114 is connected to the bottom surface 114*b*.

Specifically, the third cushioning block 116 of the cushioning apparatus 100 has a bottom surface 116*b* (in FIG. 2D) and a top surface 116*t* opposite to each other and has an outer end portion 1162 and an inner end portion 1164 opposite to each other. The outer end portion 1162 is near the first connecting block 102, and the inner end portion 1164 is far away from the first connecting block 102. The outer end portion 1162 of the third cushioning block 116 has an outer end surface 1162*a* (in FIG. 2D) facing the first connecting block 102. The inner end portion 1164 of the third cushioning block 116 has an inner end surface 1164*a* (in FIG. 2B) facing the fourth cushioning block 118.

The fourth cushioning block 118 of the cushioning apparatus 100 has a bottom surface 118*b* (in FIG. 2D) and a top surface 118*t* opposite to each other and has an outer end portion 1182 and an inner end portion 1184 opposite to each other. The outer end portion 1182 is near the second connecting block 104, and the inner end portion 1184 is far away from the second connecting block 104. The outer end portion 1182 of the fourth cushioning block 118 has an outer end surface 1182*a* (in FIG. 2D) facing the second connecting block 104. The inner end portion 1184 of the fourth cushioning block 118 has an inner end surface 1184*a* (in FIG. 2B) facing the fourth cushioning block 118.

In FIG. 2A to FIG. 2D, the outer end portion 1122 of the first cushioning block 112 is fixedly connected to the first connecting block 102. The outer end portion 1142 of the second cushioning block 114 is fixedly connected to the second connecting block 104. A portion, near the inner end portion 1144, of the top surface 114*t* of the second cushioning block 114 is connected to a portion, near the inner end portion 1124, of the top surface 112*t* of the first cushioning block 112 in a flippable manner. That is, a top surface of the inner end portion 1144 is connected to a top surface of the inner end portion 1124 in a flippable manner. A portion, near the outer end portion 1162, of the top surface 116*t* of the third cushioning block 116 is connected to the top surface 102*t* of the first connecting block 102 in a flippable manner. That is, a top surface of the outer end portion 1162 is connected to the top surface 102*t* of the first connecting block 102 in a flippable manner. A portion, near the outer end portion 1182, of the top surface 118*t* of the fourth cushioning block 118 is connected to the top surface 104*t* of the second connecting block 104 in a flippable manner. That is, a top surface of the outer end portion 1182 is connected to the top surface 104*t* of the second connecting block 104 in a flippable manner. A portion, near the inner end portion 1184, of the bottom surface 118*b* (in FIG. 2D) of the fourth cushioning block 118 is connected to a portion, near the inner end portion 1164, of the bottom surface 116*b* (in FIG. 2D) of the third cushioning block 116 in a flippable manner. That is, a bottom surface of the inner end portion 1184 is connected to a bottom surface of the inner end portion 1164 in a flippable manner.

Please refer to FIG. 2A again. In this implementation, the inner end surface 1124*a* (in FIG. 2B) of the inner end portion 1124 of the first cushioning block 112 contacts the inner end surface 1144*a* (in FIG. 2B) of the inner end portion 1144 of the second cushioning block 114 to allow the inner end surface 1124*a* and the inner end surface 1144*a* to fit each other. The first cushioning block 112 extends in the second direction D2 from the first connecting block 102, and the second cushioning block 114 extends in the second direction D2 from the second connecting block 104. A portion, near the inner end portion 1124, of the top surface 112*t* of the first cushioning block 112 is connected to a portion, near the inner end portion 1144, of the top surface 114*t* of the second cushioning block 114. The two first cushioning blocks 112, the two second cushioning blocks 114, the first connecting block 102, and the second connecting block 104 enclose to form an accommodation space 300 (in FIG. 2B). The third cushioning block 116 and the fourth cushioning block 118 are confined in the accommodation space 300.

In FIG. 2A, the inner end surface 1164*a* (in FIG. 2B) of the inner end portion 1164 of the third cushioning block 116 contacts the inner end surface 1184*a* (in FIG. 2B) of the inner end portion 1184 of the fourth cushioning block 118. A portion, near the inner end portion 1164, of the bottom surface 116*b* (in FIG. 2D) of the third cushioning block 116 is connected to a portion, near the inner end portion 1184, of the bottom surface 118*b* (in FIG. 2D) of the fourth cushioning block 118. The third cushioning block 116 extends in the second direction D2 from the first connecting block 102, and the fourth cushioning block 118 extends in the second direction D2 from the second connecting block 104.

In FIG. 2A, the outer end surface 1162*a* (in FIG. 2D) of the outer end portion 1162 of the third cushioning block 116 contacts the end surface 102*a* (in FIG. 2D) of the first connecting block 102. A portion, near the outer end portion 1162, of the top surface 116*t* of the third cushioning block 116 is connected to the top surface 102*t* of the first connecting block 102.

In FIG. 2A, the outer end surface 1182*a* (in FIG. 2D) of the outer end portion 1182 of the fourth cushioning block 118 contacts the end surface 104*a* (in FIG. 2D) of the second connecting block 104. A portion, near the outer end portion 1182, of the top surface 118*t* of the fourth cushioning block 118 is connected to the top surface 104*t* of the second connecting block 104.

Please refer to FIG. 2B to FIG. 2D. In this implementation, a first connecting edge 122 is provided between the inner end surface 1124*a* of the inner end portion 1124 of the first cushioning block 112 and the inner end surface 1144*a* of the inner end portion 1144 of the second cushioning block 114. The first connecting edge 122 is parallel to the first direction D1. A second connecting edge 124 is provided between the inner end surface 1164*a* of the inner end portion 1164 of the third cushioning block 116 and the inner end surface 1184*a* of the inner end portion 1184 of the fourth cushioning block 118. The second connecting edge 124 is parallel to the first direction D1. A third connecting edge 126 is provided between the outer end surface 1162*a* of the outer end portion 1162 of the third cushioning block 116 and the end surface 102*a* (in FIG. 2D) of the first connecting block 102. The third connecting edge 126 is parallel to the first direction D1. A fourth connecting edge 128 is provided between the outer end surface 1182*a* of the outer end portion 1182 of the fourth cushioning block 118 and the end surface

104*a* (in FIG. 2D) of the second connecting block 104. The fourth connecting edge 128 is parallel to the first direction D1. That is, the first connecting edge 122, the second connecting edge 124, the third connecting edge 126, and the fourth connecting edge 128 all extend in a same direction.

Accordingly, in the cushioning apparatus 100 of this implementation, a plurality of cushioning blocks are folded towards each other based on the connecting blocks to form a clamping groove for placing the accommodated item 200 (in FIG. 1) to absorb a shock via the thickness of the cushioning blocks. Accordingly, when the protected accommodated item 200 is impacted, the cushioning apparatus 100 is compressed to absorb impact energy to prevent the accommodated item 200 from damage due to impact.

Figure 3A:
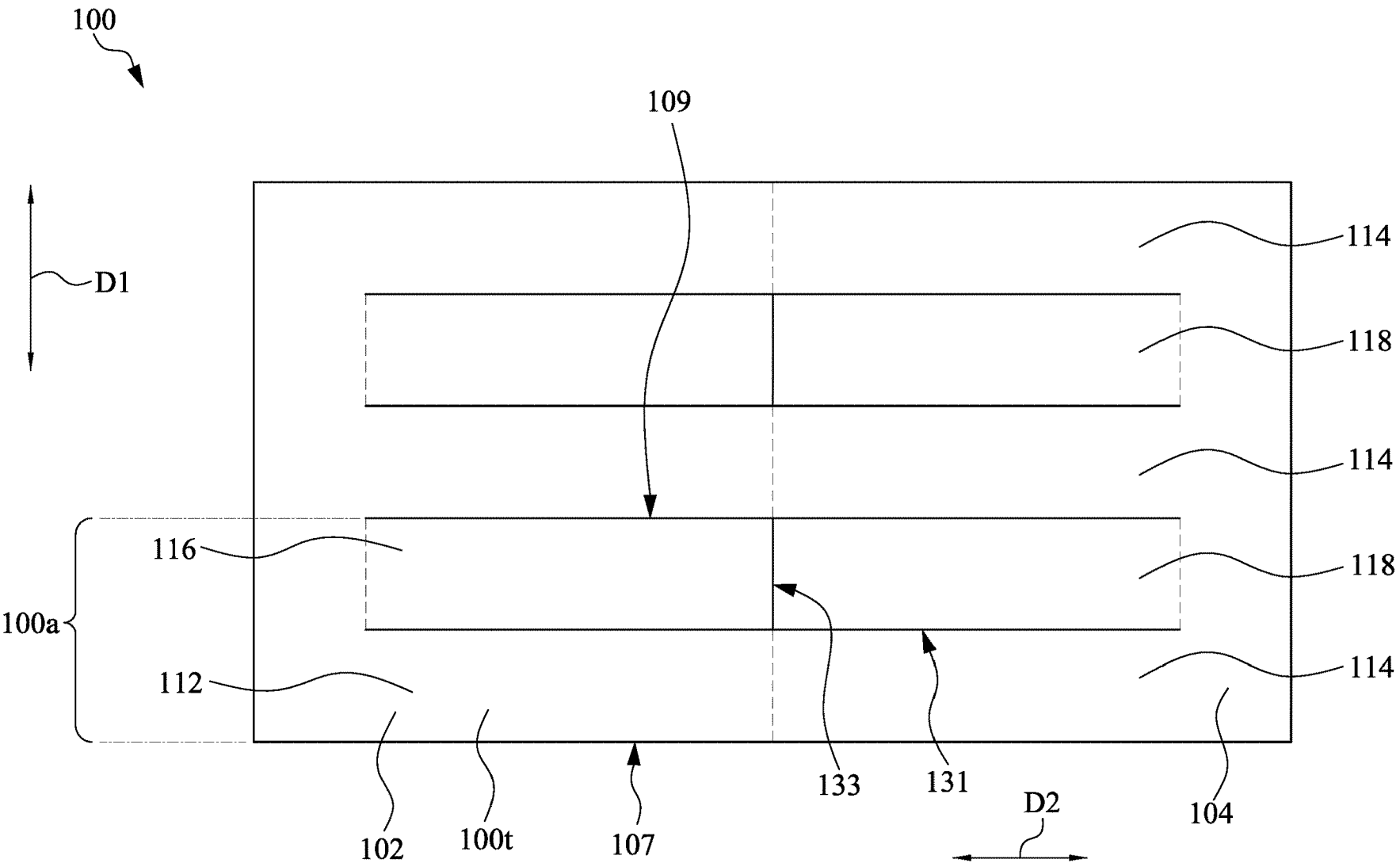
FIG. 3A and FIG. 3B are respectively a top view and a bottom view of a cushioning apparatus before the cushioning apparatus is deployed according to an implementation of the disclosure.
Figure 3B:
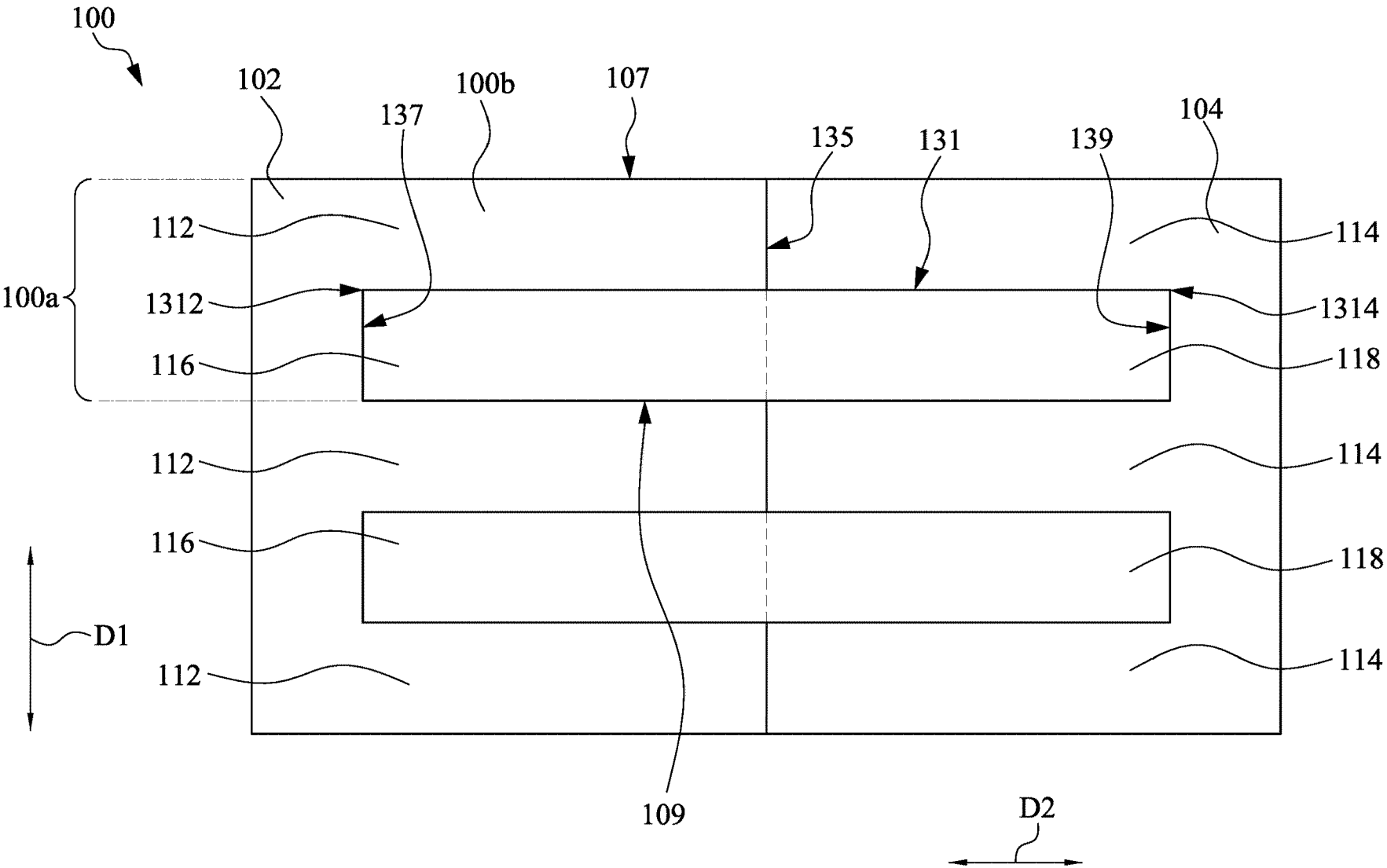
Figure 3C:
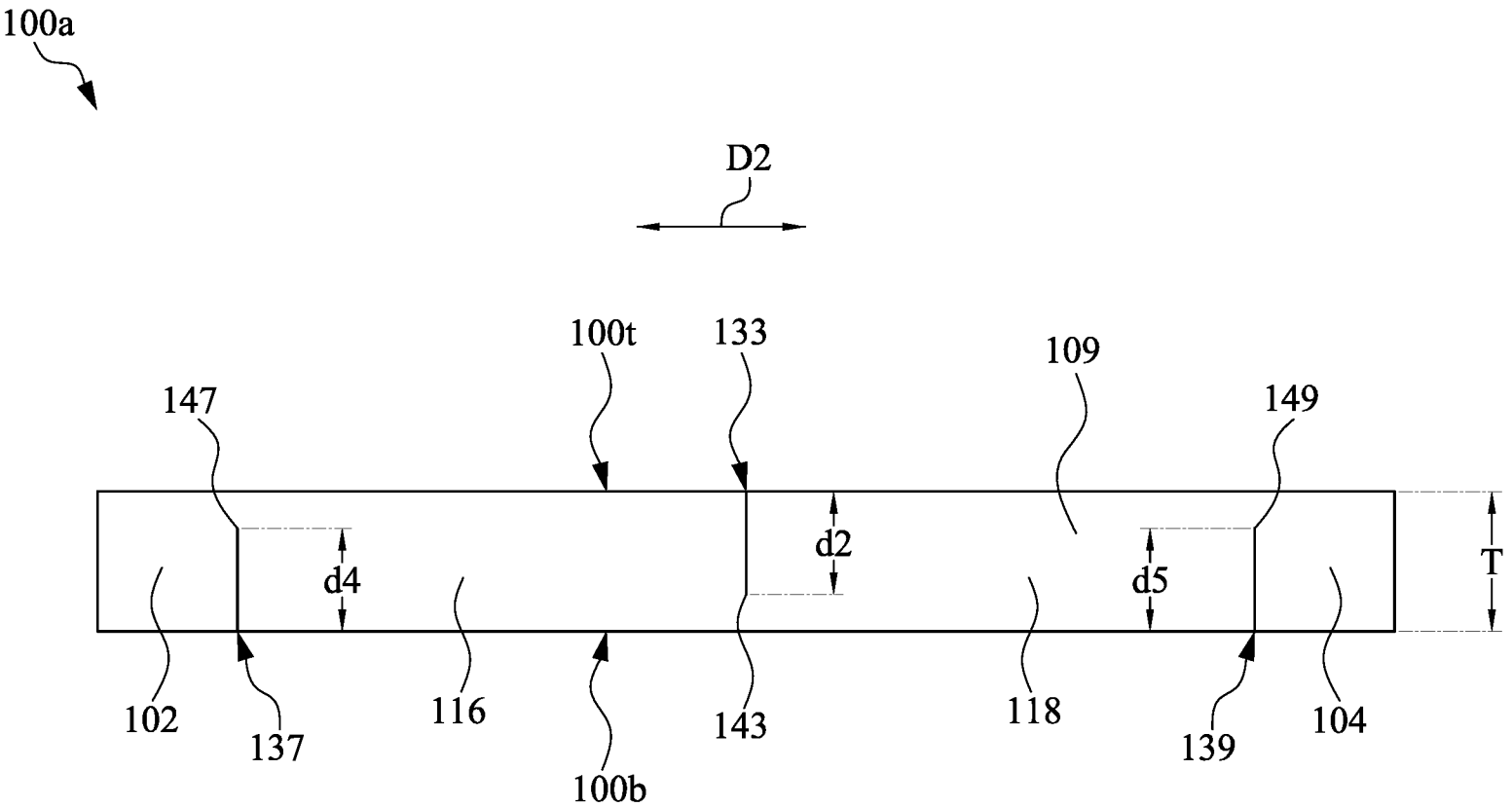
FIG. 3C and FIG. 3D are respectively side views of a cushioning unit from angles of a second lateral surface and a first lateral surface before the cushioning unit is deployed according to an implementation of the disclosure.
Figure 3D:
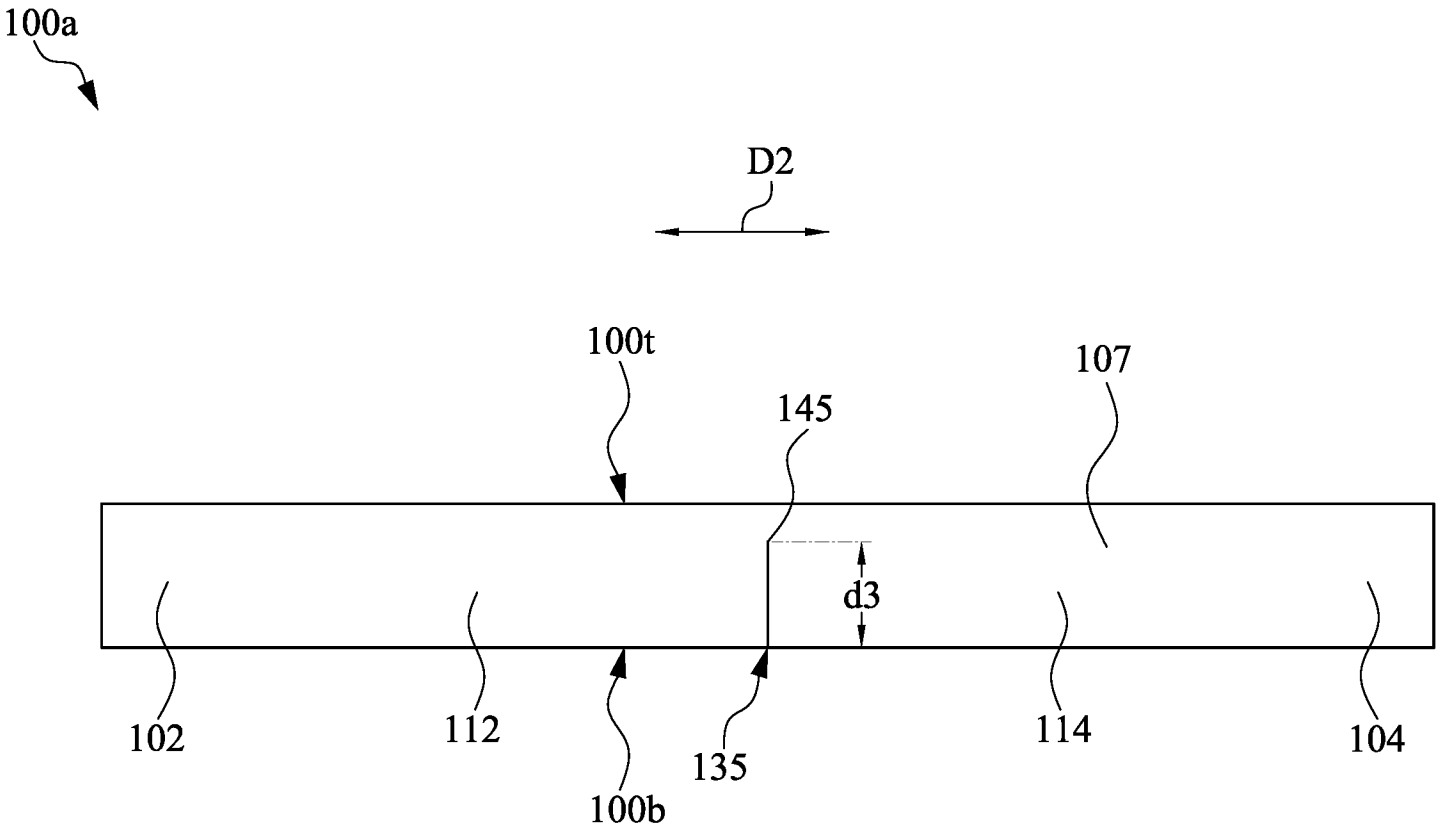

Please refer to FIG. 3A to FIG. 3D. FIG. 3A and FIG. 3B are respectively a top view and a bottom view of a cushioning apparatus 100 before the cushioning apparatus 100 is deployed according to an implementation of the disclosure. FIG. 3C and FIG. 3D are respectively side views of a cushioning unit 100*a* from angles of a second lateral surface 109 and a first lateral surface 107 before the cushioning unit 100*a* is deployed according to an implementation of the disclosure. In this implementation, the cushioning apparatus 100 is formed by cutting a plurality of cutting grooves on the cushioning unit 100*a*. However, the disclosure is not limited thereto.

In FIG. 3A to FIG. 3D, the cushioning apparatus 100 of this implementation includes at least one cushioning unit 100*a*. The cushioning unit 100*a* has a bottom surface 100*b* (in FIG. 3B) and a top surface 100*t* (in FIG. 3A) opposite to each other and has a first lateral surface 107 and a second lateral surface 109 opposite to each other. The first lateral surface 107 and the second lateral surface 109 are both connected to the bottom surface 100*b* and the top surface 100*t*. The cushioning unit 100*a* further has a first cutting groove 131, a second cutting groove 133 (in FIG. 3A), a third cutting groove 135 (in FIG. 3B), a fourth cutting groove 137 (in FIG. 3B), and a fifth cutting groove 139 (in FIG. 3B).

In FIG. 3A and FIG. 3B, in this implementation, the first cutting groove 131 is located between the first lateral surface 107 and the second lateral surface 109 and extends in the second direction D2. In addition, the first cutting groove 131 has an end portion 1312 and an end portion 1314 opposite in the second direction D2 and communicates with the bottom surface 100*b* and the top surface 100*t*. The second cutting groove 133 extends in the first direction D1 from the first cutting groove 131 to the second lateral surface 109 and extends (in FIG. 3C) from the top surface 100*t* towards the bottom surface 100*b*, and a bottom portion 143 (in FIG. 3C), far away from the top surface 100*t*, of the second cutting groove 133 is separated from the bottom surface 100*b*.

In FIG. 3B, in this implementation, the third cutting groove 135 extends in the first direction D1 from the first cutting groove 131 to the first lateral surface 107 and extends (in FIG. 3D) from the bottom surface 100*b* towards the top surface 100*t*, and a bottom portion 145 (in FIG. 3D), far away from the bottom surface 100*b*, of the third cutting groove 135 is separated from the top surface 100*t*. The fourth cutting groove 137 extends from the end portion 1312 of the first cutting groove 131 to the second lateral surface 109 in the first direction D1 and extends from the bottom surface 100*b* towards the top surface 100*t* (in FIG. 3C), and a bottom portion 147, far away from the bottom surface 100*b*, of the fourth cutting groove 137 is separated from the top surface 100*t*. The fifth cutting groove 139 extends from the end portion 1314 of the first cutting groove 131 to the second lateral surface 109 in the first direction D1 and extends from the bottom surface 100*b* towards the top surface 100*t* (in FIG. 3C), and a bottom portion 149 of the fifth cutting groove 139 is separated from the top surface 100*t*.

In this implementation, a depth d2 of the second cutting groove 133, a depth d3 of the third cutting groove 135, a depth d4 of the fourth cutting groove 137, and a depth d5 of the fifth cutting groove 139 are at least greater than a half of a thickness T of the cushioning unit 100*a*, respectively.

In actual applications, a plurality of cushioning units 100*a* is sequentially connected in the first direction D1 (in FIG. 3A). For example, before the cushioning unit 100*a* is deployed, the second lateral surface 109 of one of adjacent cushioning units 100*a* is connected to a first lateral surface 107 of the other one of the adjacent cushioning units 100*a*. Furthermore, the second cutting groove 133 (in FIG. 3A) of one of the adjacent cushioning units 100*a* is connected to the third cutting groove 135 (in FIG. 3B) of the other one of the adjacent cushioning units 100*a*. The fourth cutting groove 137 and the fifth cutting groove 139 (in FIG. 3B) of one of the adjacent cushioning units 100*a* are connected to the first lateral surface 107 of the other one of the adjacent cushioning units 100*a*.

In the disclosure, the cushioning apparatus 100 is formed by cutting a plurality of cutting grooves on the cushioning unit 100*a*. Accordingly, the cushioning apparatus 100 including the cushioning unit 100*a* may be formed by cutting a single board body thus to save the time for manufacturing the cushioning apparatus 100. In addition, the cushioning apparatus of the disclosure 100 can be completed only by the cutting step, so that a large quantity of residual materials may not be generated during manufacture. In addition, material waste is reduced during manufacture, so that manufacturing cost of the cushioning apparatus 100 can be further reduced.

The features in the foregoing implementations may enable a person of ordinary skill in the art to better understand various aspects of the disclosure. The person of ordinary skill in the art should understand that to achieve the same advantages of the implementations of the disclosure and/or the same objective, the person of ordinary skill in the art may further design or modify other processes and structures based on the disclosure. The person of ordinary skill in the art should understand that such equivalent structures do not depart from the spirit and scope of the disclosure. The person of ordinary skill in the art may make various changes, replacements and modifications herein without departing from the spirit and scope of the disclosure.

What is claimed is:

1. A cushioning apparatus, comprising:

a first connecting block;

a second connecting block;

at least one first cushioning block, an outer end portion of the first cushioning block being fixedly connected to the first connecting block;

at least one second cushioning block, an outer end portion of the second cushioning block being fixedly connected to the second connecting block, and a top surface of an inner end portion, away from the second connecting block, of the second cushioning block connected to a top surface of an inner end portion, away from the first connecting block, of the first cushioning block in a flippable manner;

at least one third cushioning block, a top surface of an outer end portion of the third cushioning block connected to a top surface of the first connecting block in a flippable manner; and at least one fourth cushioning block, a top surface of an outer end portion of the fourth cushioning block connected to a top surface of the second connecting block in a flippable manner, and a bottom surface of an inner end portion, away from the second connecting block, of the fourth cushioning block connected to a bottom surface of an inner end portion, away from the first connecting block, of the third cushioning block in a flippable manner, wherein a first connecting edge is provided between an inner end surface of the inner end portion of the first cushioning block and an inner end surface of the inner end portion of the second cushioning block, and the first connecting edge is parallel to a direction, a second connecting edge is provided between an inner end surface of the inner end portion of the third cushioning block and an inner end surface of the inner end portion of the fourth cushioning block, and the second connecting edge is parallel to the direction, a third connecting edge is provided between an outer end surface of the outer end portion of the third cushioning block and the first connecting block, and the third connecting edge is parallel to the direction, and a fourth connecting edge is provided between an outer end surface of the outer end portion of the fourth cushioning block and the second connecting block, and the fourth connecting edge is parallel to the direction.

2. The cushioning apparatus according to claim 1, wherein the number of the at least one first cushioning block is two, the number of the at least one second cushioning block is also two, the third cushioning block is located between the two first cushioning blocks, and the fourth cushioning block is located between the two second cushioning blocks.

3. The cushioning apparatus according to claim 2, wherein when an inner end surface of the inner end portion of the first cushioning block contacts an inner end surface of the inner end portion of the second cushioning block, the two first cushioning blocks, the two second cushioning blocks, the first connecting block, and the second connecting block enclose to form an accommodation space, and the third cushioning block and the fourth cushioning block are confined in the accommodation space.

4. The cushioning apparatus according to claim 1, wherein the number of the at least one third cushioning block is two, the number of the at least one fourth cushioning block is also two, the first cushioning block is located between the two third cushioning blocks, and the second cushioning block is located between the two fourth cushioning blocks.

5. A cushioning apparatus, comprising:

at least one cushioning unit having a bottom surface and a top surface opposite to each other and having a first lateral surface and a second lateral surface opposite to each other, the first lateral surface and the second lateral surface being both connected to the bottom surface and the top surface, and the cushioning unit further having:

a first cutting groove having a length extending between and parallel to the first and second lateral surfaces and having a depth extending from the bottom surface of the cushioning unit straight to the top surface of the cushioning unit;

a second cutting groove having a length extending from the first cutting groove straight to the second lateral surface and having a depth extending from the top surface of the cushioning unit and terminating prior to reaching the bottom surface of the cushioning unit;

a third cutting groove having a length extending from the first cutting groove straight to the first lateral surface and having a depth extending from the bottom surface of the cushioning unit and terminating prior to reaching the top surface of the cushioning unit;

a fourth cutting groove having a length extending from a first end portion of the first cutting groove straight to the second lateral surface and having a depth extending from the bottom surface of the cushioning unit and terminating prior to reaching the top surface of the cushioning unit; and a fifth cutting groove having a length extending from a second end portion of the first cutting groove opposite to the first end portion straight to the second lateral surface and having a depth extending from the bottom surface of the cushioning unit and terminating prior to reaching the top surface of the cushioning unit.

6. The cushioning apparatus according to claim 5, wherein the depths of the second cutting groove, the third cutting groove, the fourth cutting groove, and the fifth cutting groove are at least greater than a half of a thickness of the cushioning unit, respectively.

7. The cushioning apparatus according to claim 5, wherein the lengths of the second, third, fourth, and fifth cutting grooves are parallel to each other.

8. The cushioning apparatus according to claim 5, wherein the lengths of the second, third, fourth, and fifth cutting grooves are perpendicular to the length of the first groove.

* * * * *